United States Patent [19]

Kirchner

[11] Patent Number: 4,813,200

[45] Date of Patent: Mar. 21, 1989

[54] LARGE CONTAINER FOR POURABLE, PASTY AND SLUDGE-LIKE MATERIALS AND A METHOD OF USING THE SAME

[76] Inventor: Dietrich A. H. Kirchner, Im Winkel 1, 2091, Wulfsen, Fed. Rep. of Germany

[21] Appl. No.: 882,890

[22] PCT Filed: Oct. 28, 1985

[86] PCT No.: PCT/EP85/00572

§ 371 Date: Jun. 27, 1986

§ 102(e) Date: Jun. 27, 1986

[87] PCT Pub. No.: WO86/02620

PCT Pub. Date: May 9, 1986

[30] Foreign Application Priority Data

Oct. 29, 1984 [DE] Fed. Rep. of Germany ..... 3439574

[51] Int. Cl.[4] ..... E04G 11/04

[52] U.S. Cl. ..... 52/249; 52/245; 52/247; 405/115

[58] Field of Search ..... 52/192, 194, 245, 249, 52/63; 210/417, 418, 423, 429, 430, 440; 383/119; 405/115

[56] References Cited

U.S. PATENT DOCUMENTS

| | | | |
|---|---|---|---|
| 724,316 | 3/1903 | Morris | 383/119 |
| 1,473,845 | 11/1923 | Gardon | 52/192 |
| 1,571,295 | 2/1926 | Newman | 135/114 |
| 2,112,008 | 3/1938 | Bagby | 220/449 |
| 2,212,618 | 8/1940 | Rifkin | 220/449 |
| 2,600,908 | 6/1952 | Nachman | 112/429 |
| 3,416,762 | 12/1968 | Headrick | 52/2 |
| 3,425,228 | 2/1969 | Lamberton | 405/18 |
| 3,561,219 | 2/1971 | Masazumi | 405/19 |
| 3,570,749 | 3/1971 | Sato | 383/119 |
| 3,638,799 | 2/1972 | Serowiecki | 210/474 |
| 3,664,072 | 5/1972 | Lieckfeld | 52/245 |
| 3,696,623 | 10/1972 | Heine | 405/19 |
| 3,788,253 | 1/1974 | Rickettson | 112/417 |
| 4,036,361 | 7/1977 | Jacobson | 220/6 |
| 4,121,389 | 10/1978 | Ptaszek | 52/192 |
| 4,194,652 | 3/1980 | Williamson | 112/429 |
| 4,344,543 | 8/1982 | Hoffman | 52/249 |
| 4,390,149 | 6/1983 | Barnes | 244/126 |
| 4,603,525 | 8/1986 | Byers | 52/249 |
| 4,606,674 | 8/1986 | Capron | 52/245 |
| 4,690,585 | 9/1987 | Holmberg | 405/18 |

*Primary Examiner*—Henry E. Raduazo

*Attorney, Agent, or Firm*—Chilton, Alix & Van Kirk

[57] ABSTRACT

A large container and a method for accommodating pourable, pasty and sludge-like materials are distinguished by the use of side walls (5) of textile material. Containers are especially suitable for draining and final depositing of mud and for casting concrete structures. Supporting structures (6, 7, 8) with which the textile material (5) can be held before the containers are filled can be removed after the containers are completely filled.

17 Claims, 10 Drawing Sheets

Figure 1:
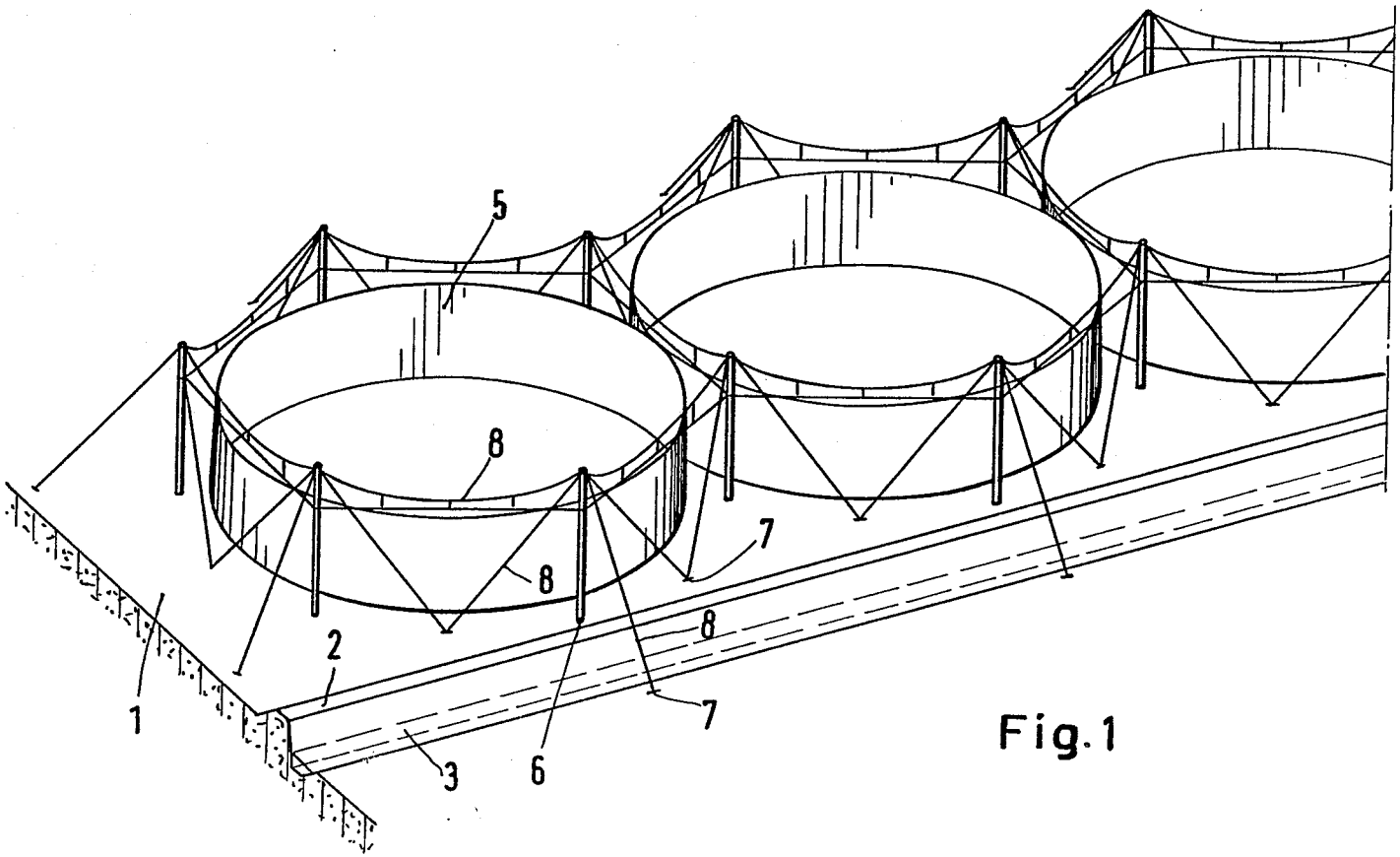

Fig. 4A
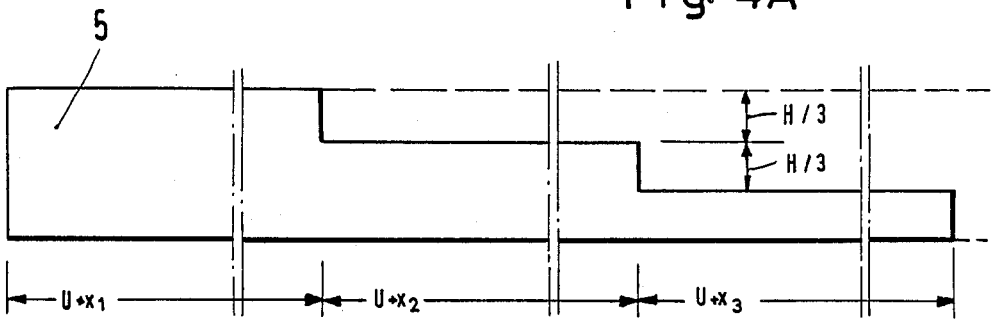
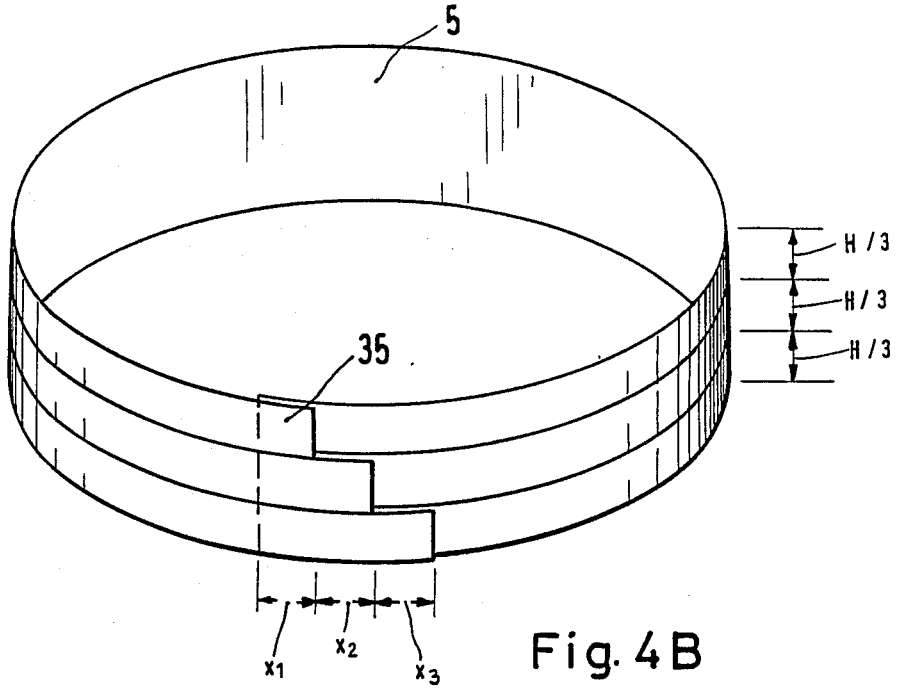
Fig. 4B

Fig. 13A
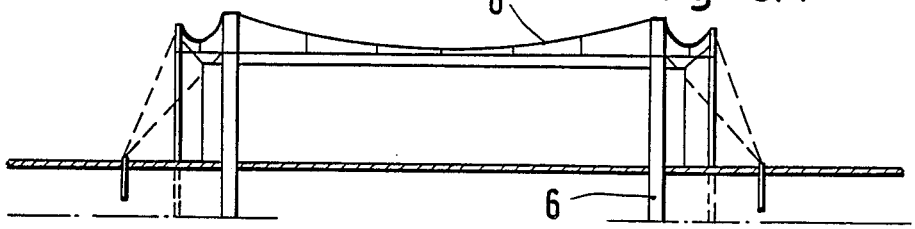
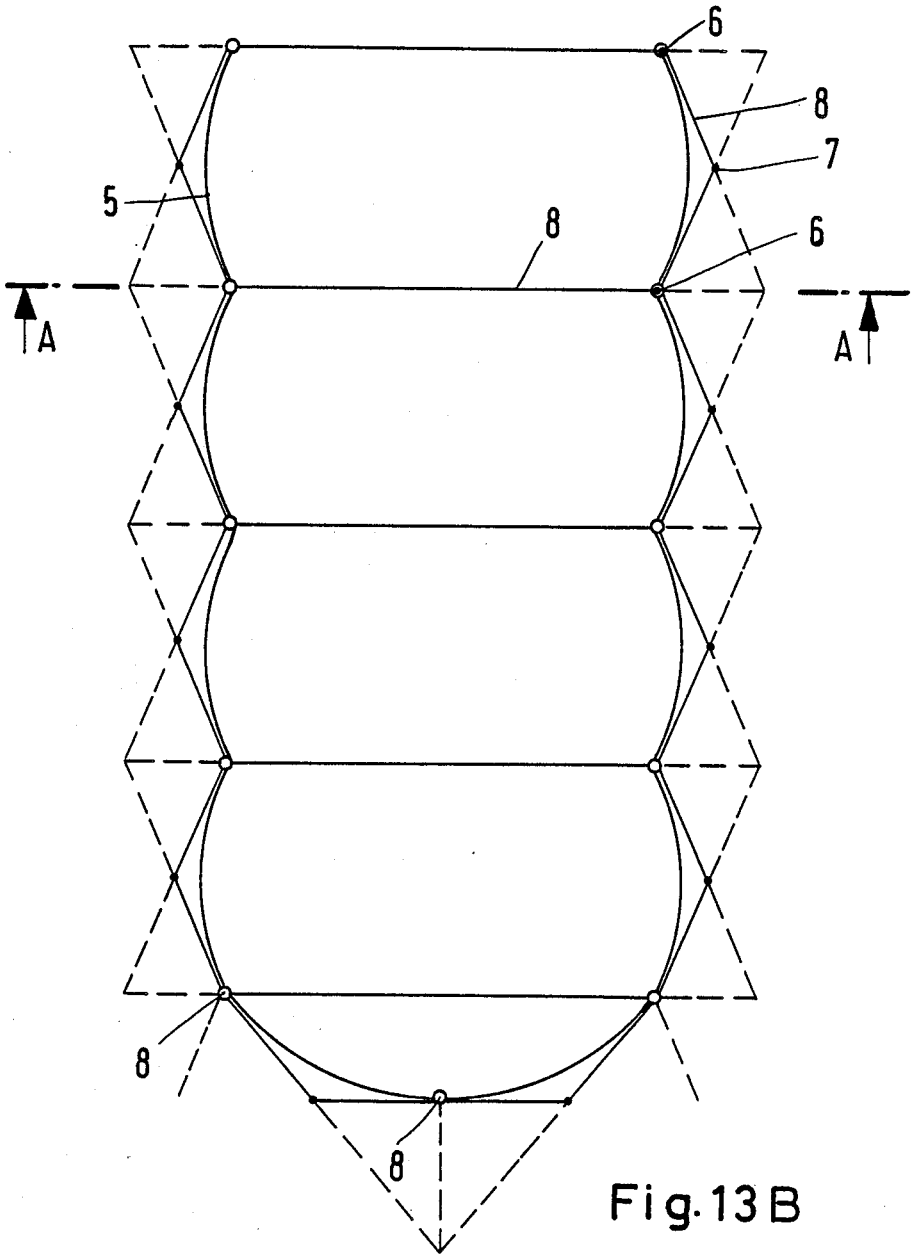
Fig. 13B

LARGE CONTAINER FOR POURABLE, PASTY AND SLUDGE-LIKE MATERIALS AND A METHOD OF USING THE SAME

The invention relates to a large container for accommodating pourable, pasty and sludge-like materials which essentially has the shape of an upright cylinder, and also to a method in which these containers can be used.

Large containers for the above-mentioned materials primarily have concrete walls or steel walls; other materials are also conceivable here, for example plastic walls. However, the disadvantage of all these containers is that the costs are relatively high. This may not be troublesome if the material is high-grade or, for example, inflammable. The application possibilities of such previously known containers is therefore limited.

Another disadvantage is that no liquid can escape through the walls. Therefore no sludge or mud for draining the same can be stored in such containers. On the contrary, the procedure is adopted of first depositing the mud behind sand dams and the like where it can drain. This normally takes a very long time, because in humid regions more water always comes from above in the form of rain. After sufficient draining, the mud can then be taken to another place for the final dumping, which requires a considerable amount of work.

In a large container of the type mentioned at the outset (East German Patent Specification No. 93,511), textile material is provided as a component of the wall material. However, this container is still very expensive, because it requires special stabilizing rings for absorbing the high circumferential tensile forces of the filled container and also permanent supporting structures. These stabilising rings and supporting structures cannot be removed after the container is filled, because otherwise the container would no longer be stable. Since it conflicts with the recognized rules of architecture to install additional bulky objects which cannot decay such as masts, steel ropes, etc., in dump sites and since these parts are in addition very expensive, the container can only be used in special cases.

A further previously known container (East German Patent Specification No. 84,588) likewise requires permanent supporting structures and in addition a special woven fabric. Finally, in the case of this container, as can be seen from the figures, it is obvious that only a relatively small container is intended and not a large container.

The object of the invention is to create a simply constructed large container which is inexpensive and can be used for purposes for which large containers could not be used previously, and which is suitable in particular for the inexpensive and space-saving processing of sludge and mud into dumps or for using in the casting of concrete.

The solution according to the invention is that the side wall is made of a textile material which is strengthened with woven fabric reinforcements which are arranged diagonally to the directions of the weft and warp.

The side wall of the container according to the invention is therefore made exclusively of textile material. Any stabilizing rings or the like are not necessary. Also not necessary are permanent supporting structures which at most have to be used just partly during the filling of the container, but can be dismantled when the container is completely filled.

As a result of the invention, a large container is created for the first time, the walls of which are made exclusively of textile material. The prejudice is thereby overcome that walls made exclusively of textile material cannot resist the forces occurring in a large container. That this is possible is because it is achieved quite substantially by the woven fabric reinforcements arranged diagonally to the directions of the weft and warp, as a result of which woven fabric reinforcements the container can no longer distort unsymmetrically. Previously, expensive permanent supporting structures had to be provided in order to avoid these possibilities and problems.

Stable textile materials suitable for the container according to the invention are, for example, the geotextiles which are used for stabilizing ground structures. At the same time, however, these geotextiles have thus far normally been more or less sheet-like so that, firmly embedded into the soil, they reinforce the ground. It is the contribution of the invention to have recognized for the first time that even upright large containers can be created by means of this textile material. Because of the invention, the prejudice is overcome that this material is not suitable for walls of large containers as a result of the considerable forces occurring.

Woven textile fabric in particular can be used as the textile material.

As a result of the invention, it has been recognized that the finished container with its filling, apart from the textile material, does not require any further supports; the textile material is held in the container shape by the contents. The container is therefore very inexpensive. However, the textile material is suspended from a supporting structure before the container is completely filled, because only in this way can appropriately large containers be obtained.

Since the side walls of textile materials are essentially arranged upright, an especially large amount of material can be stored in the large containers in a small area. In many cases, however, at least some walls will be provided which are not upright but are arranged at an angle. If, for example, it is intended to cast a dam, a dyke or the like from concrete which has to be sloped at least on one side so that the waves can flow out here, the corresponding formwork for casting the concrete can be formed with textile walls by means of the large container according to the invention, with the front textile wall then having the desired inclination of the front surface of the dam or dyke. A rear surface of the dam or dyke can of course also be inclined, although more or less upright walls will frequently be used here for space-saving reasons.

To form in particular such a dam or dyke, the container can be constructed from several sections, with the side wall of textile material having several areas which form the partial surfaces of cylinder jackets. However, even sludge dump sites can be constructed in this manner.

A particularly simple container comprises an essentially circular cylinder. Such containers can of course also be erected next to one another.

In circular-cylindrical large containers, the supporting structure can be removed when the container is filled and the material incorporated therein has settled. For this purpose, the supporting structure preferably has dismantable steel masts and steel wires. The steel masts and steel wires thus dismantled can then be inexpensively used for the construction of a new container. But the textile material remains in situ. If several containers have been arranged next to one another for a dump site and the intermediate spaces between the containers have been filled with the material to be deposited, the textile material remaining in the dumped material fulfils the purpose of a lasting ground stabilization or stabilization of the dumped material.

In an empty container, not only must the upper edge of the possibly relatively large textiles be secured by the supporting structure but also the lower edge, so that the structure also remains stable in wind in the assembly condition before filling. Once the container is filled, the textile material no longer needs to be secured in the lower area. If provision is now made for the steel masts to be provided in the lower area with downwardly directed spikes, hooks or the like for securing edge parts of the container, the spikes, hooks or the like will secure the textile material here when the steel masts are driven into the ground. If the steel masts are pulled out once the container is filled, the spike, hook or the like releases the textile material; therefore it is not necessary to first dig out the textile material at the edge area and laboriously release the connection.

In an advantageous embodiment, hollow bodies which can be filled with pressure fluid and have flexible walls are provided as a supporting structure in addition to the steel ropes and steel masts or as a supporting element instead of these steel ropes and steel masts. In particular, the hollow bodies can be essentially perpendicular hose sections closed at the ends. If these at first slack hose sections are filled with pressure fluid (e.g. water or compressed air), they form more or less rigid supports which hold up the container wall until the container is filled.

If the hollow bodies are hose sections which are arranged in a zigzag shape diagonally to the weft and warp and are closed at the ends, a further increase in stability is thus obtained.

In particular, the hollow bodies or hose sections can be provided on the inside on the textile side wall. In this case, the following advantageous effect can also be achieved.

If the hose sections are only fitted with relatively little pressure fluid, so that they are at first still more or less slack, and if the container is held up by other means, the pressure fluid, when the container is gradually filled, is pressed out of the lower parts of the hose section and therefor expands the upper part of the hose sections and therefore reinforces the latter. The upper edge of a partly filled container is thus well supported. In sludge dump sites, the remaining supporting structures could then be removed after the container has been filled just once. If the filling level drops as a result of the partial draining of the sludge, the upper part of the edge, which is not released, does not collapse but remains upright, so that further sludge can be reintroduced at any time, namely depending on the lowering of the surface of the sludge quantity already introduced.

Any type of supporting structure with which the entire container has to be stretched before filling is not only elaborate and expensive but must also be of a stable size. This is less necessary for holding the relatively small weight of the textile wall than for being able to withstand in some cases considerable wind pressures during a storm in the assembly condition before filling. This entire problem can be overcome—especially when the container is filled with flushing stock—and a container can be substantially simplified and made less expensive if the side wall is provided with buoyancy bodies at its upper edge.

In this case, the container, ready prepared in the factory, is laid flat with its base part onto the correspondingly prepared foundation. The textile wall, appropriately folded, is laid onto the base from the edge of the base towards the center, so that an appropriate opening remains in the center, at the edge of which opening the buoyancy bodies are provided which are connected to the upper edge of a side wall. If flushing material is now introduced, the buoyance bodies lift from the base and thus stretch the wall more and more as the filling level rises. At the same time, provision can also be made for the side wall itself to be made such that it is capable of floating (e.g. by appropriately treating the woven fabric or by incorporating or attaching air cushion mats and the like).

This construction with the buoyancy bodies is not only very simple, it also requires no assembly personnel at the erecting site for masts, wire ropes and the like. The wind pressure also no longer causes a problem, because the container is exposed to wind only insofar as it is already disposed upright as a result of filling. However, the corresponding part of the container is adequately secured against the wind by the material which has been introduced.

If larger quantities of material are layered, there is the risk of the foundation soil being pressed out laterally beneath the container by the pressure (foundation failure). This is avoided if the base consists of a textile mat which is connected at its edge to the cylindrical wall. At the same time, this textile mat essentially has similar functions to the known geotextiles; it is intended to transmit the pressure of a superimposed material layer onto the foundation in suitable manner.

As a result of the hydrostatic pressure, which increases from top to bottom, and an resilience which is typical of the material and which is shown by all textile materials, the container will assume a slightly larger diameter in the lower area than it originally had and also maintains in the upper area. So that the connection between the base reinforcement mat and the side wall is not destroyed here in the base area, it is advantageously provided that extension folds with predetermined tearing seams are provided near to the connecting location of mat to wall.

The diameter which decreases from bottom to top has the further advantage that the horizontal hydrostatic and soil pressure forces of the material which has been introduced has an upwardly directed component by which the wall material is likewise pressed upward. In this case, the corresponding lifting of the wall material is not produced by the buoyancy bodies alone.

The wall is advantageously made at least partly in several layers, in particular wound, and has more textile layers in the lower area than in the upper area. This embodiment likewise takes into account the fact that the hydrostatic pressure of the deposited material is greater at the bottom, which here also leads to a greater tensile force on the textile material. In this way, the stepped thickness of the container wall is in conformity with the forces occurring. However, one or more layers of a material can also be used, the thickness of which increases from top to bottom by the thickness of the warp threads, for example, increasingly accordingly. In this case, the thickness of the container increases more or less continuously from top to bottom and thus conforms better to the tensile force which likewise continuously increases from top to bottom.

The supporting structure can be arranged outside the container. However, provision can also be made for the container to have a center support on which, for example, a tent-like roof can be fixed. Because of this roof, the material can be prevented from always becoming wet as a result of rain, which can be important in particular in the case of sludge to be dried. However, if the sludge, for example, is introduced from above in the center of the container, it will have a slightly inclined surface toward the edge of the container, which is further promoted by the sludge level dropping quicker in the edge area by draining through the textile material. A portion of the rain water runs off in this "natural roof", so that the tent-like roof can possibly be dispensed with, which of course facilitates the construction.

In a preferred embodiment, the container is made double-walled with an intermediate space for accommodating material between the walls. Thus, for example, concrete rings and the like can be made if the container is first filled up to the inner wall with, for example, sand and then filled with concrete between the inner wall and the outer wall. Once the concrete has set, the sand is then removed again from the inner container.

However, not only concrete rings can be made with this container. A concentric inner container (in this case relatively small) could also be provided inside a larger container, the walls of which are of course also made of textile material and which is filled, for example, with gravel. In this case, the draining of the sludge could be considerably facilitated, because the water can run off not only on the outside but also in the center. At the same time, this inner, relatively small container can best be held by a center support, from which a ring can be suspended from which the textile material hangs down in a cylinder shape.

The connection of the various woven fabric layers, if several lie one above the other, or of the woven fabric wall to the woven fabric reinforcements can be made in various ways. For example, the woven fabric could be secured here between plates by means of rivets, with the rivets being inserted through the textile material, while carefully displacing the individual threads, in such a way that no threads tear. These rivets give a connection at some areas which is particularly strong in tension.

The rivet connection is further improved, if, before riveting, the superimposed woven fabric layers or textile layers are impregnated with an adhesive, polyester casting resin or the like. The layers thus impregnated are then compressed between the plates which are then riveted to one another. In this way, a particularly reliable and high-tensile connection is obtained which transmits in sequence all forces occurring in the textile layers.

However, alternatively or in addition thereto, the woven fabric layers and/or the woven fabric reinforcements can also be connected to one another by sewing, by using adhesives, by heat sealing or possibly also by combinations of these methods.

Especially advantageous, in particular for the draining of the sludge, is a cylindrical container with a diameter between 10 and 50 meters, in particular between 20 and 30 meters. In an advantageous embodiment, the height of the container is between 2 and 8 meters, in particular between 4 and 6 meters.

In an advantageous method for depositing mud, sludge and the like, the mud, sludge or the like is introduced into one or more containers in the form of upright cylinders having textile walls and repeatedly reintroduced after the surface drops as a result of draining, with the supporting structure then being subsequently removed if such a supporting structure has been used at all.

At the same time, it is advantageous to arrange several containers next to one another so that a dam is formed, the front side of which, after draining, is provided with a continuous embankment; further sludge or mud is deposited behind this dam.

However, instead of several upright cylindrical containers next to one another, one or more containers can be used in such a way that they are constructed from several sections, with the side wall of textile material having several areas which form partial surfaces of cylinder jackets.

The main advantage of the invention, however, is that a large amount of material can be deposited in a very small space in an inexpensive manner: this is achieved in that, after the draining of a layer formed as described, at least one further layer with containers and sludge/mud is constructed on the first layer.

However, the method according to the invention is also suitable for casting concrete. In an advantageous embodiment for building dams, walls and the like, in which concrete is introduced into a formwork and solidifies there, provision is made according to the invention for textile walls to be used in the form described. At the same time, the permeability to water of the textile walls can be controlled by selecting or treating the textile material according to requirement.

Figures 2A, 2B:
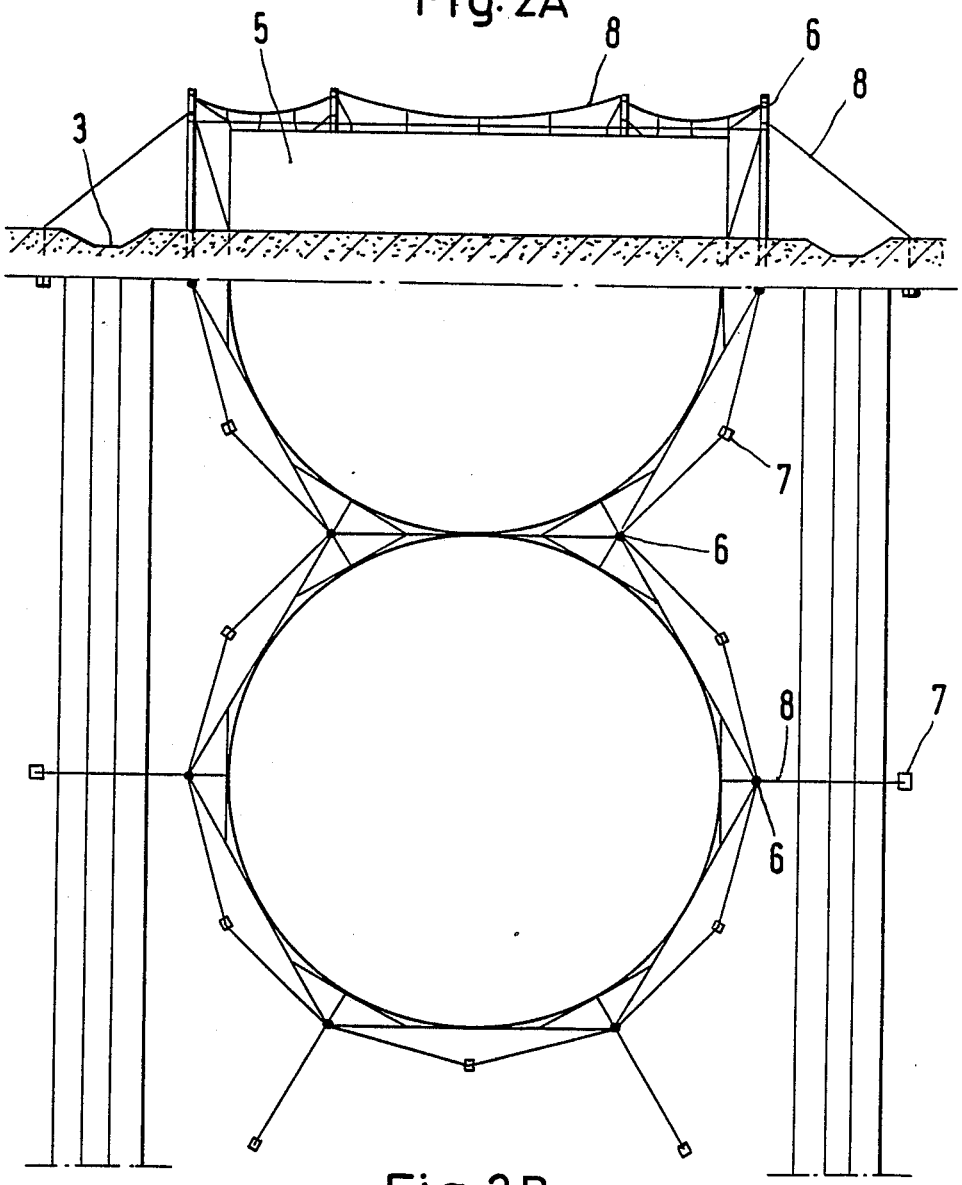
Figure 3A:
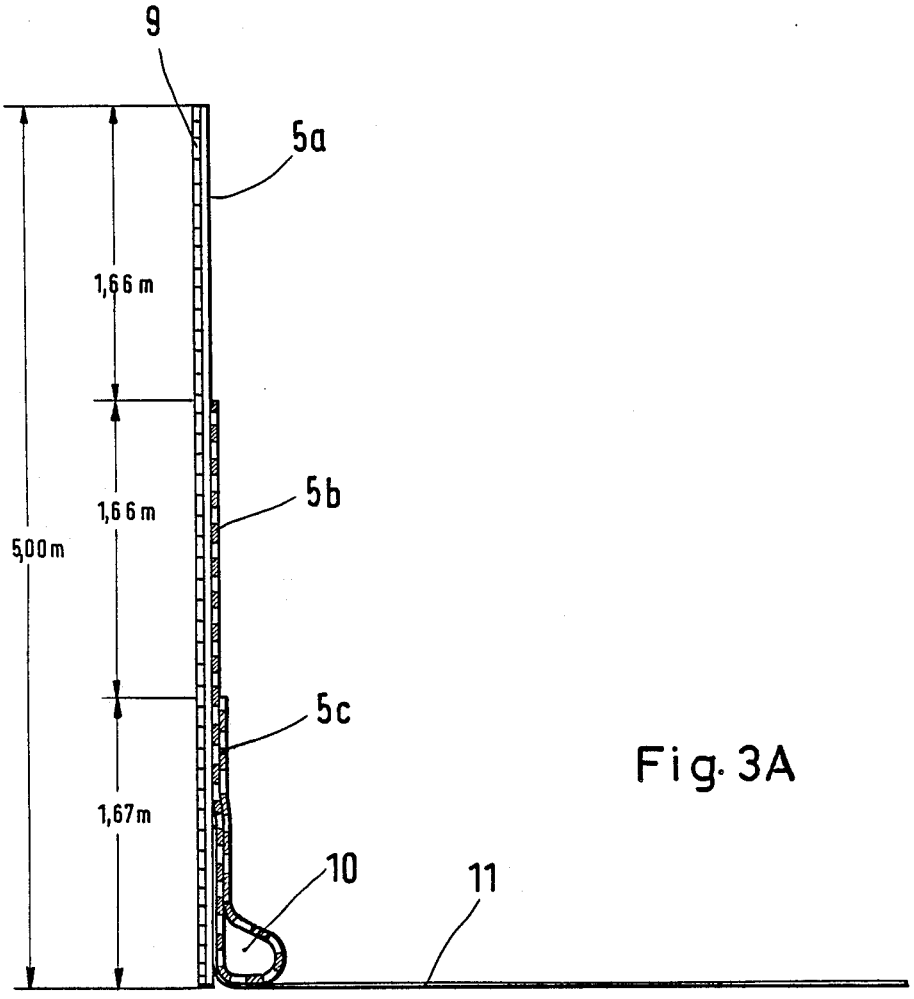
Figure 3B:
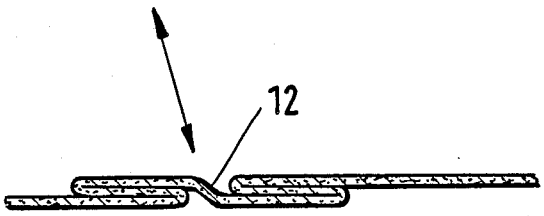
Figure 5:
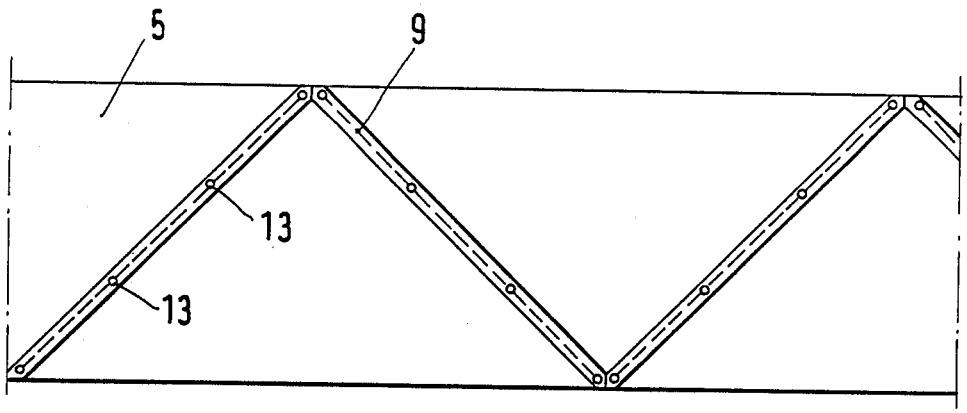
Figure 6:
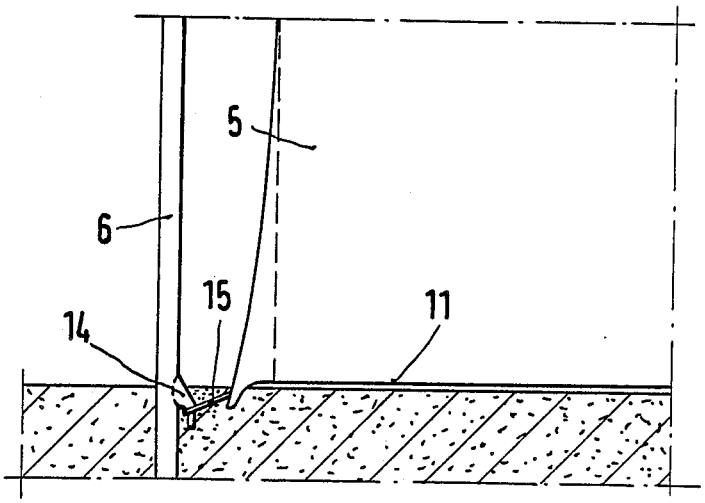
Figure 7:
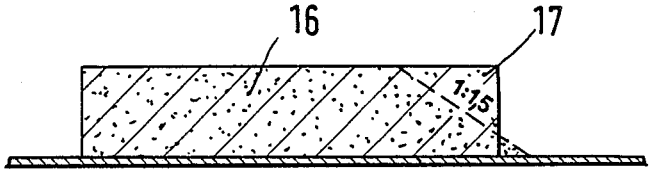
Figure 8:
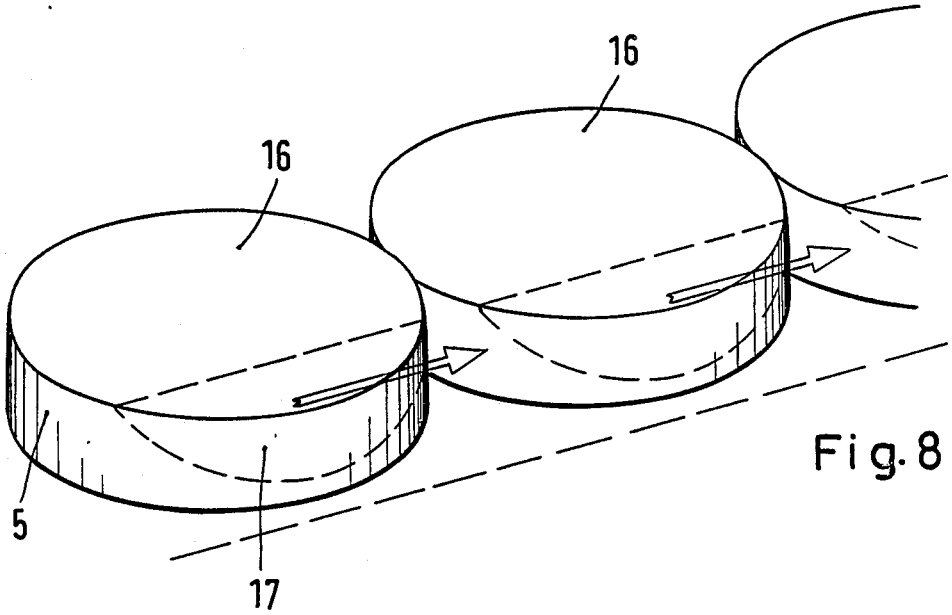
Figure 9:
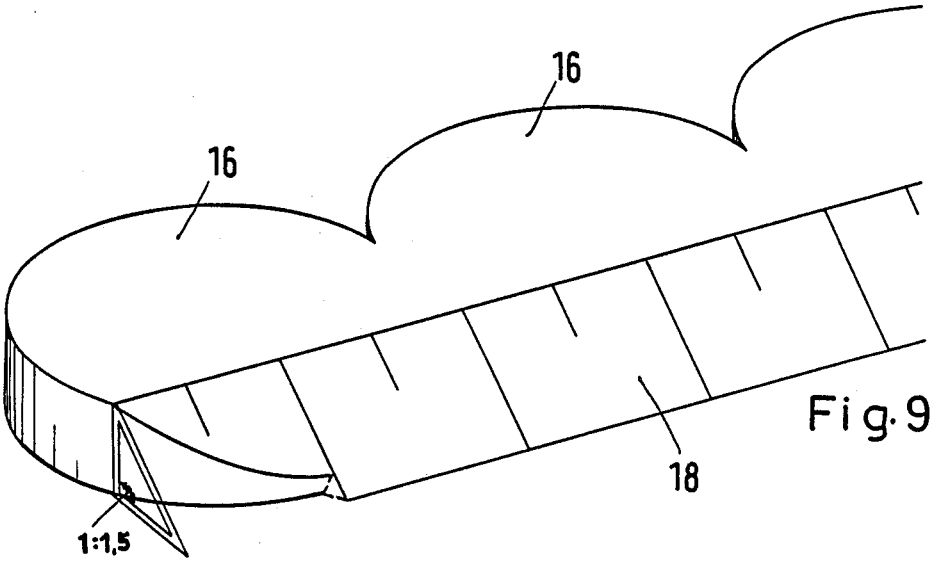
Figure 11:
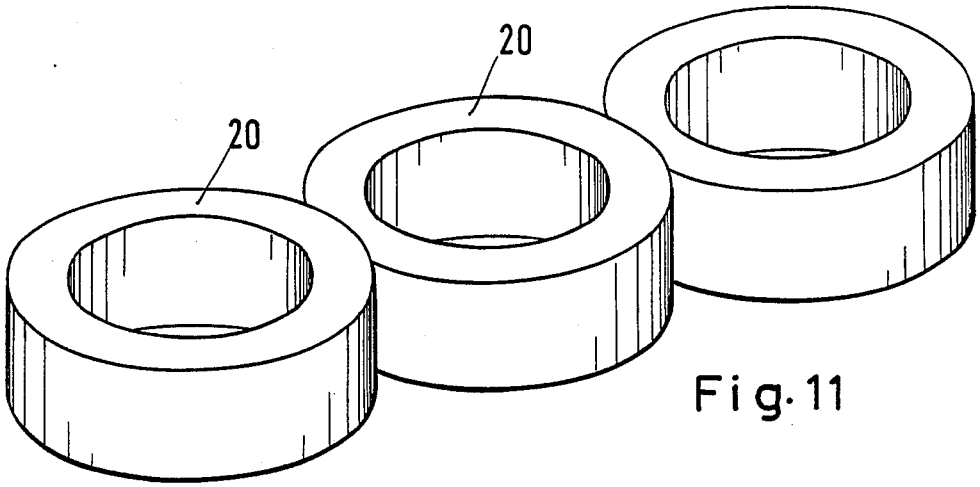
Figure 10:
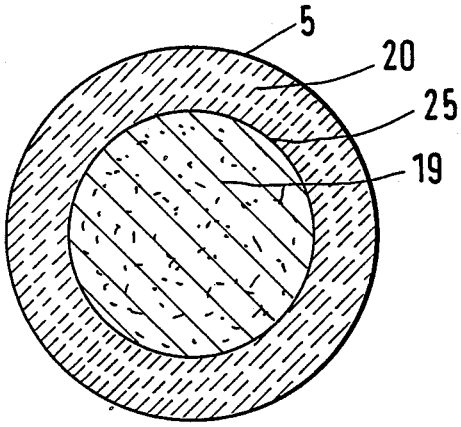
Figure 12:
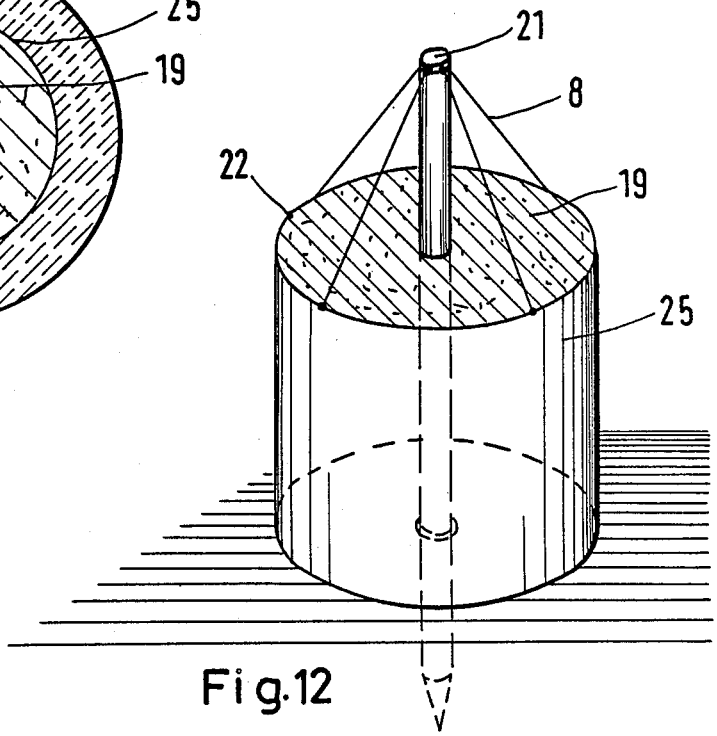
Figure 14:
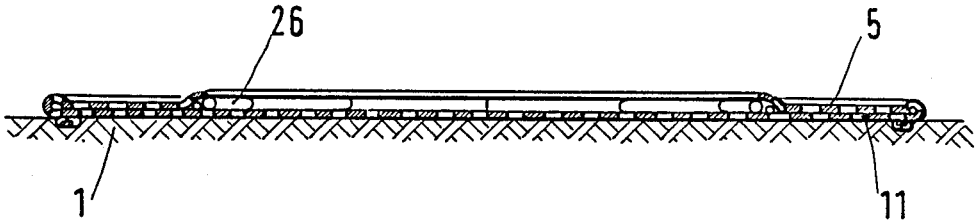
Figure 15:
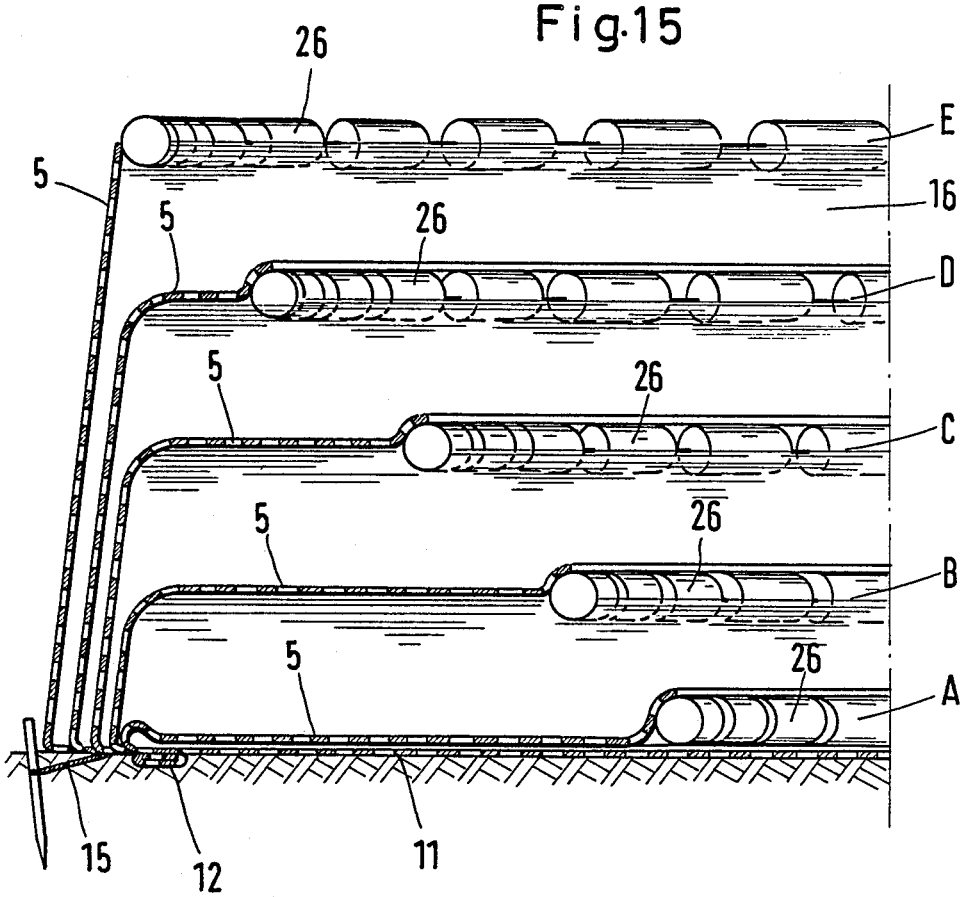
Figure 16A:
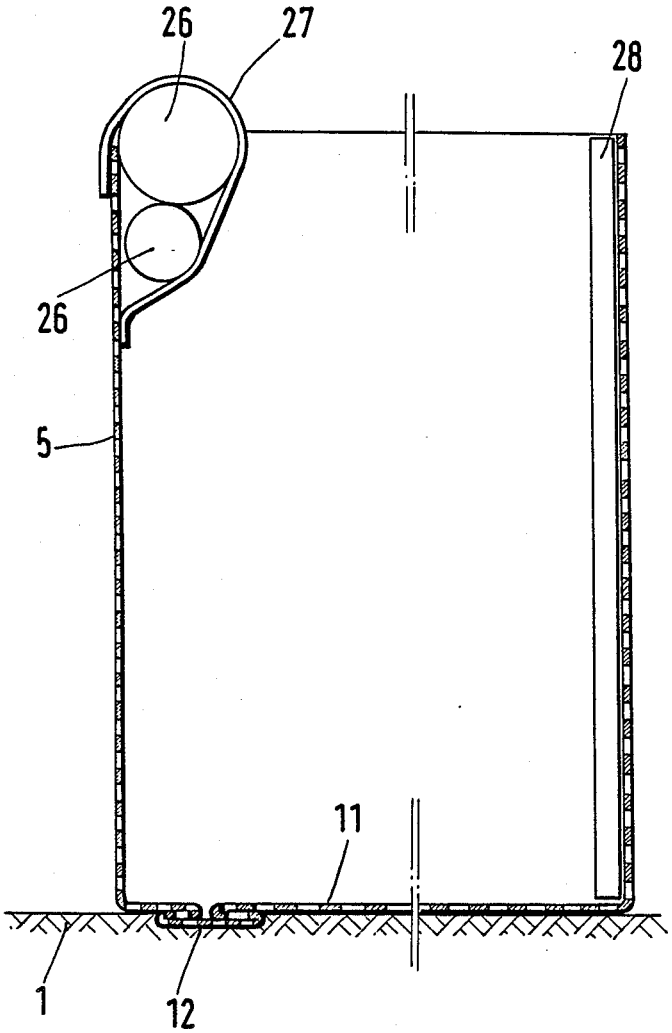
Figure 16B:
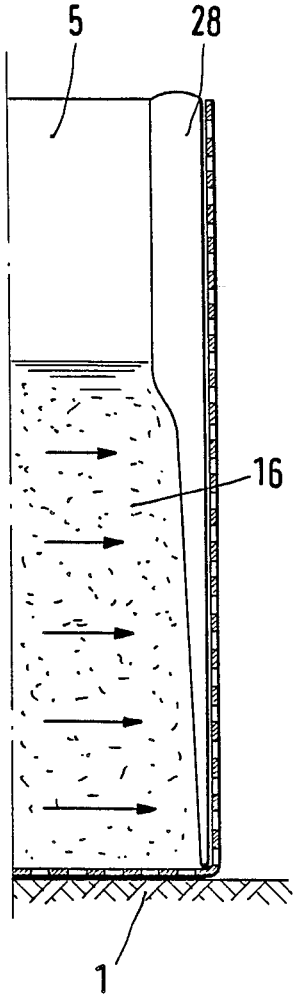

The invention is described below by means of advantageous embodiments with reference to the attached drawings, in which:

FIG. 1 shows a perspective view of several container constructions according to the invention placed next to one another; FIG. 2 shows the container constructions of FIG. 1 at (A) in a side view and at (B) in plan view; FIG. 3 shows a section through the container; FIG. 4 shows the arrangement of the textile material for a container similar to that of FIG. 3; FIG. 5 shows the textile material with diagonally running woven fabric reinforcements; FIG. 6 shows a section through a container which shows the interaction with the supporting pile in the lower area of the latter; FIG. 7 shows a cross-section through a dam which can be obtained with several containers; FIG. 8 shows the container with material which has been introduced, after removing the supporting structures; FIG. 9 shows the material of the containers of FIG. 8 after an embankment has been made; FIG. 10 shows a cross-section through a double-walled container, with which, for example, concrete rings can be made; FIG. 11 shows concrete rings arranged together in a row which can be made with the embodiment of FIG. 10; FIG. 12 shows a further container which can be arranged inside the container, for example, of FIGS. 1 to 3 and is filled with another material for draining the material arranged around it; FIG. 13 shows another container constructed from several sections; FIG. 14 shows a section of another embodiment of the container according to the invention before filling; FIG. 15 shows a cross-section of an edge area of the container of FIG. 14 at various stages of filling; and FIG. 16 shows cross-sections through edge areas of another embodiment of a container.

As shown in FIGS. 1 and 2, several containers are constructed on the ground 1 on an area which is bounded by a protective wall 2 and a trench 3. In this case, the containers consist of paths of textiles arranged in a circular cylinder, in particular woven textile fabrics 4 which are stretched by appropriate supporting structures. These supporting structures have means 6, ground anchors 7 and wire ropes 8.

As shown in FIG. 3, the textile material is partly made in several layers. In the uppermost part, only one material layer 5*a* is provided, on which reinforcement, shown in FIG. 4, of textile bands 9 is provided only on the outside diagonally to the warp and weft in order to improve the strenghtening of the woven fabric. A further layer of the same or similar material 5*b* is applied on the lowermost two-thirds of the textile path; connection is effected at the same time by riveting, by heat sealing, by adhesive or the like. This textile path 5*b*, while forming a hose-shaped bulge 10, is laid and turned around at the bottom and guided upward again, where it forms the third layer at 5*c* in the lowermost third portion. The bulge 10 can be filled, for example, with sand, so as to secure the woven textile fabric on the ground at this location. Between the layer 5*a* which extends fully to the ground, and the layer 5*b*, a further textile layer 11 is inserted which forms a ground reinforcement mat.

Since the container will expand more in the radial direction than in the upper area during filling as a result of the hydrostatic pressure in the lower area, the ground mat 11, at the edge area, has expansion folds with predetermined tearing seams which are indicated as 12 at (B).

In the embodiment shown in FIG. 3, the outermost textile layer is th one which runs through from the very top to the very bottom. However, more favorable loading conditions are obtained if the innermost textile layer is the one which runs through from top to bottom, so that the additional layers are therefore applied on the outside in the lower area, since the horizontal connecting seams between the individual layers are thus subjected to substantially less stress on account of the hydrostatic internal pressure. This is shown schematically in FIG. 4, in which the individual textile layers are additionally constructed from a single, stepped, cut-to-size textile portion 5. The cut-to-size portion is shown at (A) and the pre-constructed wall is shown at (B). This wall is advantageously prefabricated and sewn, riveted and the like in a factory hall, because this is very difficult or completely impossible on the construction site because of the wind prevailing there. FIG. 4 also shows that the individual layers overlap at 35. At these overlaps 35, they can be connected to one another particularly well by riveting or the like over a large area, so that the risk of tearing can be avoided. These overlaps can also be provided in single-layer textile walls.

FIG. 5 shows the above-mentioned textile reinforcement 9 which can be fixed on the textile path 5, for example at 13, with rivets arranged at intervals. At the same time, the textile materials can be held together by metal plates so as to thus distribute forces over a larger area. In addition thereto, the reinforced woven fabric can be sewn on or fixed in some other way, as indicated by the broken line.

FIG. 6 shows a detail of the supporting piles 6, namely a downwardly directed hook 14 which engages into a corresponding loop, a fixing rope 15 or the like for the textile wall 5 and the ground reinforcement mat 11. This ensures that the container remains stable against the effects of the wind even before the material is introduced. If the supporting structure is subsequently removed, and therefore if the supporting pile is also pulled out, after the container is filled, the hook 14 is automatically released from the fixing rope 15 or the like, so that here costly separation of the connection is not first required.

The containers of FIGS. 1 and 2 are shown in FIGS. 7 to 9 after the material 16 which has been introduced has settled. In this case, as shown in the Figures, the supporting structure could be removed. The material cylinders thus arranged next to one another are now provided with an embankment by means of, for example, a bull-dozer at 17 by the part 17, shown dotted in FIG. 7, in each case being displaced to the side in order to fill up the space between adjacent material cylinders 16. For this purpose, the textile material will have to be cut open beforehand on the cylinder wall along the dotted line. In this way, a dam is obtained which has a continuous embankment 18 on one side. On the other side, further sludge can be incorporated behind the dam, which sludge can likewise drain off. After such a drained material layer (in an advantageous embodiment at a height of 5 meters) has been made, the process can be re-started in exactly the same way on the base surface thus newly formed, so that several layers of the material can be deposited one above the other.

In cross-section from above, FIG. 10 shows the case in which two containers according to the invention are arranged concentrically to one another. In this case, the container has an inner wall 25 in addition to its outer wall 5. The inner container thus formed inside the wall 25 can be filled, for example, with sand or gravel 19. Concrete can then be introduced at 20. Once the concrete has set, the concrete rings 20 shown in FIG. 11 are then obtained after the sand 19 is removed from the inside of the concrete rings.

FIG. 12 shows a particularly simple type of the container with its textile wall 25 whichis likewise filled with gravel 19. For this purpose, the textile wall 25 has been suspended from a center pile 21 by means of wire ropes 8 and a ring 22. After the gravel 19 has been introduced, the sludge or mud can be inserted between the wall 25 and the outer container wall 5, which sludge or mud can then drain not only outward through the textile material but also inward through the gravel material 19.

FIG. 13 shows another type of the container according to the invention which consists of several sections 36. These sections 36 correspond to cylinders which are placed next to one another and merge into one another. At the same time, the width of the sections 36 can be half the diameter of the cylinders.

A textile path 5 is arranged between supporting piles 6, as is apparent from FIG. 13 (a plan view is shown at (B) and a section along line A—A is shown at (A)). After the container is filled, the textile path 5 will press outward between two adjacent supporting piles 6, so that the shape shown in the Figure is assumed, in which case this shape can of course already be prepared by the suspension wires 8. Normally, the supporting piles 6 will have to remain behind after the container is filled if several of such containers are not arranged next to one another and the intermediate spaces are also not filled with material. Of course, the supporting piles likewise need not remain behind if the container is filled with concrete, for example for producing a dam. In this case, the supporting piles 6 and the rest of the supporting structure can be removed once the concrete has hardened. Depending on the material selected, the textile material then decays more or less automatically on account of the chemical action of the concrete or the sunlight.

FIG. 14 shows another embodiment of a container according to the invention in the unfilled condition. The container is merely placed flat on the appropriately prepared plot 1, with its base 11 resting on this plot 1. The side wall 5 is folded inwards, so that it forms an outer annular area on the base 11. The folds developing during this procedure are fixed, for example, by predetermined breaking seams. At the inner edge (the upper edge after filling), the side wall 5 is provided with buoyancy bodies 26 which in this embodiment have a cylindrical shape.

If the container is now filled, the buoyancy bodies 26 flot on the material introduced and thus gradually straighten up the side wall 5 as shown in FIG. 15 progressing from A to E as the filling level rises. At the same time, the side walls 5 are stretched and the folds provided beforehand open by the predetermined breaking seams being destroyed. Moreover, the buoyancy bodies 26 move away from one another as the circular line on which they are arranged increases in circumference. The predetermined breaking seam 12 at the base also gradually opens, so that the container gradually receives a larger diameter at the bottom as the filling level rises, as also shown in FIG. 15.

As shown on the left-hand side in FIG. 16, the buoyance bodies 26 can be secured by textile bands 27 or the like which can then be opened after the container is filled, so that the float bodies 26 can be removed and used further at another location. However, the buoyancy bodies could also be sewn directly into the side wall 5 and the entire side wall could also be made such that it can float, for example, inserting appropriate air cushion mats into the side wall or attaching them on the latter.

In the center in FIG. 16, a hose-shaped element 28 is shown which can be arranged perpendicularly and can be provided instead of or in addition to the float bodies 26 (in each case between two float bodies 26). If this hose-shaped element 28 is filled with compressed air or water under pressure or another fluid, it therefore forms a supporting structure for holding the wall until the container is filled.

On the right-hand side in FIG. 16, such a hose-shaped element 28 is shown which has been filled only partly with fluid, in particular a liquid, so that it is first of all slack. As the filling level rises as a result of the material 16, the water or the other fluid is compressed in the lower area of the hose 28, so that the hose is expanded at the top above the filling mass 16 and thereby becomes more or less rigid, so that it can stretch the side wall 5 here as a supporting structure in the upper area.

Calculations of the inventor show that the container according to the invention and the method according to the invention enable the sludge or mud to be accommodated and dried very advantageously. If the container is first filled with mud and is then filled up again with mud (at constantly shorter intervals) when the filling level has dropped as a result of draining, the originally incorporated mud can assume essentially only one-third of its volume substantially quicker than before and completely fill the container. Taking into account the fact that the mud can also be brought up to higher dumping heights completely without risk, a considerable reduction in the space requirement is obtained, compared with the previously known methods, as a result of the omission of the previously required pre-drying on dump sites of large areas. Moreover, crucial costs are saved, since the mud can remain lying after drying; it does not need to be moved to another site for final depositing after drying.

As already mentioned several times, however, the container according to the invention and the method according to the invention can be used for casting concrete. In this case, the fact can be utilized that textiles which vary greatly in their permeability to water are available, so that the setting of the concrete can be specifically controlled; for there are textiles which are absolutely impermeable to water (for example coated with rubber) and textiles which are exceptionally permeable to water. The imperviousness to the passage of water can be increased, for example, by using fleece.

I claim:

1. A large container for accommodating pourable, pasty, sludge-like materials which has a side wall in the shape of an upright cylinder, wherein the side wall (5, 25) consists essentially of textile material having weft and warp components, the material being strengthened with woven fabric reinforcements (9) which are arranged diagonally to the directions of the weft and warp, the container having a diameter between about ten and fifty meters.

2. A large container for accommodating pourable, pasty and sludge-like materials which has a side wall in the shape of an upright cylinder, wherein the side wall (5, 25) consists essentially of a textile material having weft and warp components, the material being strengthened with woven fabric reinforcements (9) which are arranged diagonally to the directions of the weft and warp, wherein the container has a height between about two and eight meters.

3. The container as claimed in claim 1 or 2, wherein the textile material is made of woven textile fabrics.

4. The container as claimed in claim 1 or 2, wherein the textile material (5, 25) is held by a separate supporting structure (6, 7, 8, 28) before the complete filling of the container.

5. The container as claimed in claim 1 or 2, wherein the container is constructed from several sections, with the side wall of textile material having several areas which form partial surfaces of cylinder jackets.

6. The container as claimed in claim 4, wherein the supporting structure has steel masts (6) and steel ropes (8) that can be dismantled after the container has been filled.

7. The container as claimed in claim 6, wherein the container rests on the ground and the steel mats (6) have upper and lower ends, the lower ends having downwardly directed means for securing the container to the ground.

8. The container as claimed in claim 4, wherein the supporting structure has hollow bodies (28) which can be filled with pressure fluid and have flexible walls.

9. The container as claimed in claim 8, wherein the hollow bodies (28) are essentially vertically oriented hose sections closed at the ends.

10. The container as claimed in claim 1 or 2, wherein the side wall (5) has an upper edge and buoyancy bodies (26) are attached to said upper edge.

11. The container as claimed in claim 10, wherein the side wall (5) is made such that it is capable of floating.

12. The container as claimed in claim 1 or 2, further including a textile mat base (11) which is connected at its edge to the side wall (5, 25).

13. The container as claimed in claim 12, wherein the mat base has extension folds (12) with predetermined tearing seams near the connection of the mat base to the side wall.

14. The container as claimed in claims 1 or 2, wherein the side wall (5, 25) has upper and lower regions and is made at least partly in several wound layers, and wherein the side wall has more textile layers in the lower region than in the upper region.

15. The container as claimed in claim 4, wherein the supporting structure has a support (21) vertically extending in the center of the container.

16. The container as claimed in claims 1 or 2, wherein the container is double walled thereby defining an intermediate space (20) for accommodating the material between the walls (5, 25).

17. The container as claimed in claim 14, wherein the fabric layers are riveted to one another (at 13) without damaging individual threads.

* * * * *